US006017138A

United States Patent [19]

Reiss et al.

[11] Patent Number: 6,017,138

[45] Date of Patent: Jan. 25, 2000

[54] MOTOR VEHICLE HEADLAMP HAVING A DISCHARGE LAMP WITH MASKS AND A MULTI-ZONE REFLECTOR

[75] Inventors: Benoît Reiss, Paris; Jean-Pierre Aynie, Le Pre Saint Gervais, both of France

[73] Assignee: Valeo Vision, Bobigny, France

[21] Appl. No.: 08/965,740

[22] Filed: Nov. 7, 1997

[30] Foreign Application Priority Data

Nov. 8, 1996 [FR] France ..... 96.13667

[51] Int. Cl.[7] ..... F21V 7/00

[52] U.S. Cl. ..... 362/297; 362/516; 362/517; 362/518; 362/539; 362/303; 362/305; 362/348; 362/255; 362/256

[58] Field of Search ..... 362/516, 517, 362/518, 539, 303, 305, 348, 297, 255, 256

[56] References Cited

U.S. PATENT DOCUMENTS

| | | | |
|---|---|---|---|
| 4,100,594 | 7/1978 | Gould | 362/308 |
| 5,086,376 | 2/1992 | Blusseau | 362/518 |
| 5,299,101 | 3/1994 | Serizawa | 362/510 |
| 5,567,044 | 10/1996 | Lopez | 362/517 |
| 5,671,995 | 9/1997 | Serizawa et al. | 362/510 |

FOREIGN PATENT DOCUMENTS

| | | |
|---|---|---|
| 0 466 605 | 1/1992 | European Pat. Off. . |
| 0 645 578 | 3/1995 | European Pat. Off. . |
| 195 43 008 | 5/1996 | Germany . |
| 2 271 629 | 4/1994 | United Kingdom . |
| 2 296 559 | 7/1996 | United Kingdom . |

OTHER PUBLICATIONS

French Search Report dated Aug. 8, 1997.

*Primary Examiner*—Sandra O'Shea
*Assistant Examiner*—Ronald E. DelGizzi
*Attorney, Agent, or Firm*—Morgan & Finnegan, L.L.P.

[57] ABSTRACT

A motor vehicle headlamp has a discharge lamp, a reflector and a smooth or nearly smooth cover lens, the reflector being adapted to generate a beam below a cut-off line. At least two masks are associated with the discharge lamp, and define two shadow zones on the reflector; the reflector includes at least two reflective zones for forming portions of the beam below the cut-off line, with different amounts of sideways spreading of the light; and these zones of the reflector are separated by generally radial transition planes, at least some of which extend into the shadow zones. A particular application is to enable wide cruising beams to be produced to European standards without any optical anomalies.

27 Claims, 8 Drawing Sheets

MOTOR VEHICLE HEADLAMP HAVING A DISCHARGE LAMP WITH MASKS AND A MULTI-ZONE REFLECTOR

FIELD OF THE INVENTION

The present invention relates in general terms to motor vehicle headlamps. More particularly, it relates to a headlamp of the kind in which the reflector has a surface which is preferably defined mathematically, and which is adapted in particular to form by itself a European standard cruising beam with a light source consisting of a lamp having a certain type of mask or occulting element.

BACKGROUND OF THE INVENTION

The Company Valeo Vision is the proprietor of numerous patents relating to reflective surfaces which are capable of producing by themselves beams of given configurations, and in particular European standard type cruising beams which are of substantial width without any intervention by the cover lens of the headlamp. Such surfaces are entirely effective when they are used in cooperation with light sources that consist of incandescent filaments.

However, there is today a tendency to use, instead of filament lamps, discharge lamps which are known to produce a particularly high light output. Nevertheless, this type of light source has the disadvantage that the geometry of the pattern of emission of light by the source is not well controlled, so that when the above mentioned carefully defined reflective surfaces are used in conjunction with discharge lamps, there is a high degree of degradation of the photometry of the resulting light beam, in particular as regards the generation of a clean cut-off.

In addition, any cut-out, interruption or discontinuity in the surface of the reflector, which may be desirable in the case where it is required to generate portions of the beam having different positions within the final beam, and having different degrees of widthwise spread, will run the risk of giving rise, having regard to the high energy of the light source, to parasitic radiation which tends to dazzle the drivers of vehicles travelling in the opposite direction.

Thus, with a discharge lamp the designer has a natural tendency to continue to use entirely smooth reflective surfaces, which may be striated, and this imposes constraints on the technology.

This is why it has been proposed, in particular in United Kingdom patent specification GB 2 296 559, to place any cut-outs, interruptions or discontinuities, which may be present for example in the transition region between two zones of the reflector, in correspondence with shadows defined by masks associated with the light source. The arrangements described in that patent are however limited to the case where the reflective surfaces are parabolic. The zone of the reflector which forms the main part of the beam (i.e. an upper zone) has a surface which corresponds to the same paraboloid over its whole extent. The reflector is then unable to generate by itself a directly usable wide beam, so that the use of a striated cover lens is necessary, with the usual disadvantages of this type of lens, such as loss of light flux in the lens, limitations in the degree of spread that can be obtained using striations, and so on.

DISCUSSION OF THE INVENTION

An object of the present invention is to overcome the above mentioned drawbacks in the current state of the art, and to propose a headlamp which has a reflector which, although it may have discontinuities and although the light source is a discharge lamp, will at the same time generate a cut-off beam of satisfactory photometry, substantially without any parasitic light.

According to the invention, a motor vehicle headlamp, comprising a discharge lamp, a reflector, and a smooth or very slightly deviating cover lens, the reflector being adapted to generate a beam situated below a cut-off line, is characterised in that at least two masks, defining two shadow zones on the reflector, are associated with the lamp, and in that the reflector comprises at least two reflective zones for forming portions of the beam situated below the said predetermined cut-off line with degrees of spread in different widths, and in that the said zones are separated by generally radial transition planes, at least some of which extend into the said shadow zones defined by the said masks.

In a headlamp according to the invention, any cut-outs, interruptions or discontinuities between the various zones of the reflector, which are present due to the fact that the zones of the reflector spread the light sideways by different amounts, will not cause any prejudicial anomalies in the beam.

The reflector preferably includes a first zone extending essentially sideways with respect to the lamp.

According to a preferred feature of the invention, the said first zone extends between a first half plane and a second half plane, the said half plane being inclined above and below the horizontal respectively, and the half plane inclined below the horizontal extends into one of the two shadow zones.

Preferably, the said first zone comprises a first sub-zone close to the lamp and having a horizontal generatrix based on a parabola so as to cause the reflected radiation to be convergent, and a second sub-zone spaced away from the lamp and having an essentially parabolic horizontal generatrix.

The generatrices of the first and second sub-zones are preferably joined together with continuity and without any interruption of slope.

According to another preferred feature of the invention, the second sub-zone includes a plurality of striations for spreading the light, the said striations being carried on a base surface generated with the aid of the said generatrix.

Preferably, these spreading striations are distributed in at least two groups of striations, with at least a first group providing horizontal spreading of the light and at least one second group providing spreading of the light in an oblique direction which is essentially parallel to an inclined portion of the said cut-off line.

The spreading striations preferably include a third group of striations defining a curve guide which ensures continuous transition from one striation to another, as between striations of the first group and striations of the second group.

Preferably, the said first zone extends between a radial half plane inclined at about 25 degrees above the horizontal and a radial half plane inclined at about 30 degrees below the horizontal.

According to a further preferred feature of the invention, the reflector includes a second zone extending both above the first zone and into a lateral portion of the reflector opposed to the first zone.

This second zone is preferably delimited by the said first half plane and by a third half plane situated substantially in alignment with the first half plane and extending into the other shadow zone. The third half plane is preferably a radial half plane inclined at about 20 degrees below the horizontal.

Preferably, the second zone has a base surface, the horizontal generatrix of which has a profile giving a horizontal deviation which, going from the center towards the side edges of the zone, varies between two nil values, passing locally through maximum values of convergence and of divergence. The said horizontal generatrix of the second zone is preferably continuous and without interruption of slope. Alternatively or in addition, the said horizontal generatrix is preferably of parabolic form in two lateral sub-zones. In that case, striations, for horizontal spreading of the light, are preferably formed on the base surfaces of the two lateral sub-zones.

According to yet another preferred feature of the invention, the reflector includes a third zone extending into its lower part, between the first and second zones.

Preferably, the said third zone has a surface, the horizontal generatrix of which has a profile giving a horizontal deviation which, going from the center towards the lateral edges of the zone, varies between two nil values, passing locally through maximum values of convergence and of divergence. The said horizontal generatrix of the second zone is preferably continuous and without any interruption of slope. Alternatively or in addition, the said horizontal generatrix is preferably of parabolic form in two lateral sub-zones.

The surface of the said third zone is preferably entirely smooth and without any interruption of slope.

In appropriate embodiments of the invention, the generatrices of the base surface of the second zone and of the surface of the third zone are preferably not coincident, and the said generatrices may have different base focal lengths. In this latter case, the focal length of the generatrix of the surface of the third zone is preferably shorter than the focal length of the generatrix of the surface of the second zone.

According to a still further preferred feature of the invention, the geometric axis of the said third zone is offset downwardly with respect to the geometric axis common to the first and second zones, and extends parallel to the said common axis. This downward offset may for example be about 1 to 2 millimeters.

According to another preferred feature of the invention, one of the zones of the reflector has striations applied by geometric projection on a smooth base surface, and the striations, before projection, have different curvatures on either side of a summit.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

In the description that follows, the various features of the reflector will be described with the aid of an orthogonal or Cartesian frame of reference (O, x, y, z), where O is a reference point situated in the base region of the reflector, Oz is the axis of the reflector, Oy is vertical, and Ox is perpendicular to Oy and Oz. In the event that certain documents cited in the following description refer, for the definition of surface equations, to frames of reference with different orientations, a person familiar with this technical field will of course be able to make the necessary adaptations by simple permutation of variables in the equations.

In addition, the description will be given in respect of a headlamp which is adapted for driving on the right, that is to say the nearside of the vehicle is on the right, the headlamp having a normalised cut-off which rises on the right. The person skilled in the art will be able to make the necessary adaptations for driving on the left, for example by symmetrical transformation with respect to a vertical plane passing through the axis of the reflector.

Figure 1:
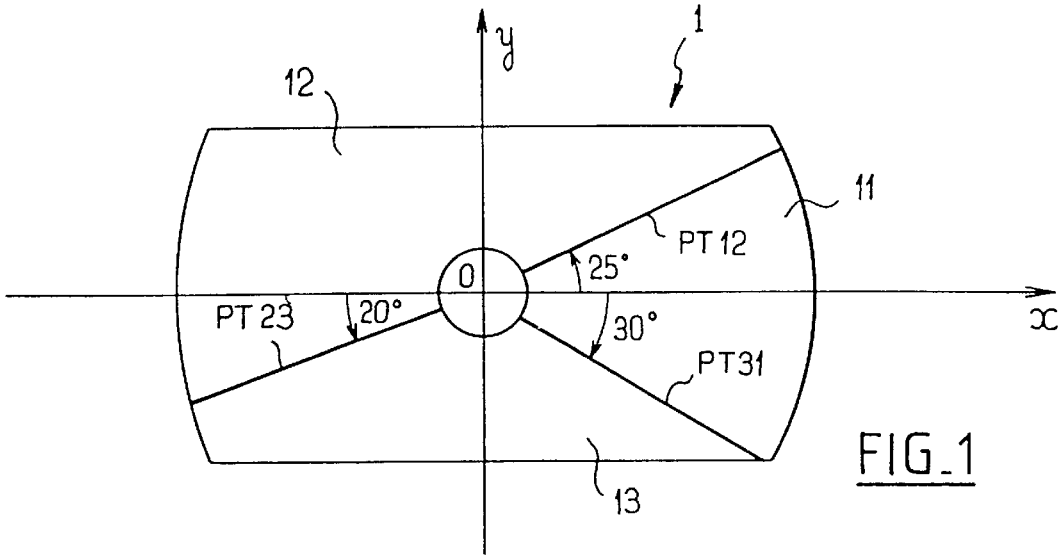
FIG. 1 is a front view of a reflector for a motor vehicle headlamp in accordance with the invention.

With reference to FIG. 1, this shows a reflector for a headlamp (or headlight) in accordance with the invention. This reflector is adapted to give by itself the desired light distribution for a normal cruising beam of the European type, that is to say the front lens (not shown) of the headlight is smooth or has no more than a very slight deviating capability.

Figure 2:
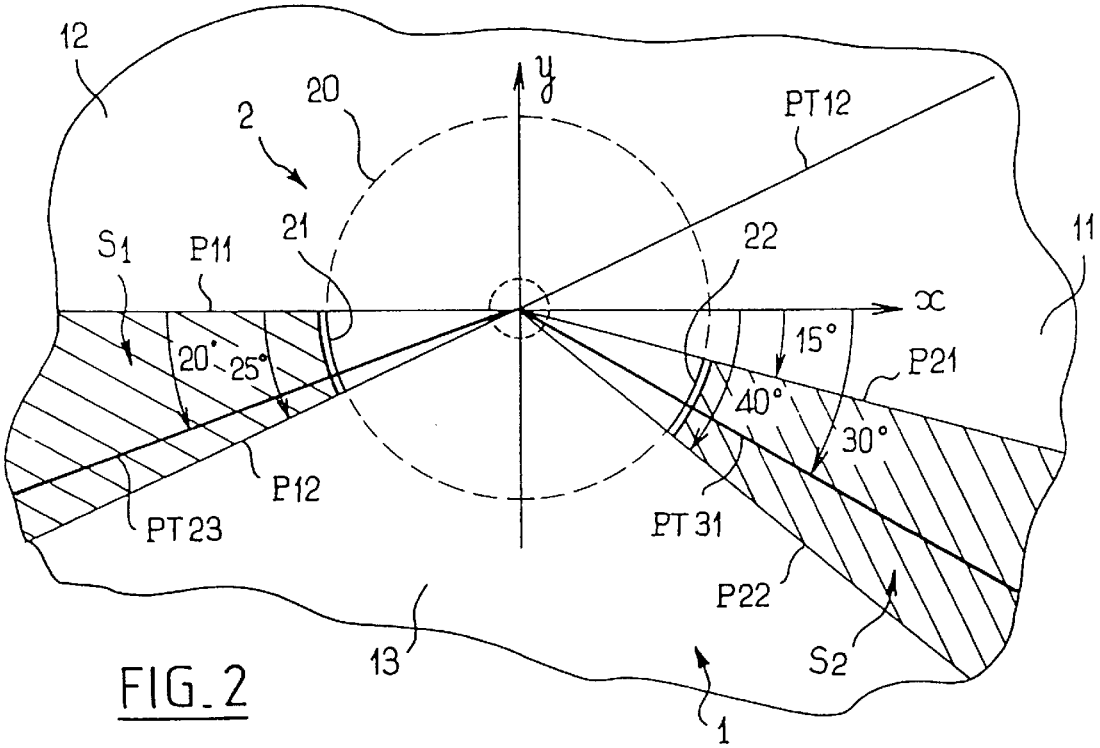
FIG. 2 is a front view of the associated discharge lamp and its masks.

The reflector is indicated by the general reference numeral 1, and is sub-divided into three distinct reflective zones 11, 12 and 13 which are joined to each other in a manner that is either continuous or discontinuous. The reflector is adapted to cooperate with a discharge lamp 2 which is shown diagrammatically in FIG. 2 and which incorporates two masks or occulting elements, which in this example consist of bands 21 and 22 of opaque paint applied to the globe 20 of the discharge lamp.

These opaque bands 21 and 22 are configured in such a way as to mask the radiation issuing from the arc of the discharge lamp in two well-defined angular sectors, each of which has an extent of 25 degrees. These sectors consist of a first sector S1, and a second sector S2. The sector S1 extends between two half planes P11 and P12, one of which is horizontal, the other being inclined at 25 degrees below the half plane P11, and the two half planes passing through the axis of the discharge lamp. The second sector S2 extends between two half planes P21 and P22 inclined respectively at 15 degrees and 40 degrees below the horizontal, these two half planes also passing through the axis of the discharge lamp.

These masked zones S1 and S2, or shadow zones, are conventionally arranged in cooperation with the discharge lamp in order to facilitate formation by the reflector of a normalised European cut-off beam, which is delimited by one horizontal half plane on the offside and one half plane rising at 15 degrees above the horizontal on the nearside. It will of course be understood that these numerical values are in no way limiting.

In addition, the discharge lamp may, in another version, include masks or occulters which are separate components fitted around the globe of the discharge lamp, and which consist for example of metallic bands for absorbing light.

Two of the three radial half planes of transition between the three reflective zones 11, 12 and 13 of the reflector lie in the sectors S1 and S2 which are masked by the opaque bands 21 and 22. In particular, the transition half plane PT12 between the zone 11 and the zone 12 of the reflector is in this example inclined at +25° above the horizonal, while the transition half plane PT23 between the zones 12 and 13 is inclined by 20° below the horizontal on the lateral side opposed to the discharge lamp. The third transition half plane, PT31, is inclined at −30° below the horizontal on the same side as the half plane PT12.

Again, these values are of course in no way limiting, in particular with a view to increasing the symmetry of the surface with respect to the vertical axial plane yOz, and facilitating adaptation of the headlight for driving on the left hand side of the road.

The structure and optical function of each of the zones 11, 12 and 13 of the reflector 1 will now be described.

Figure 4:
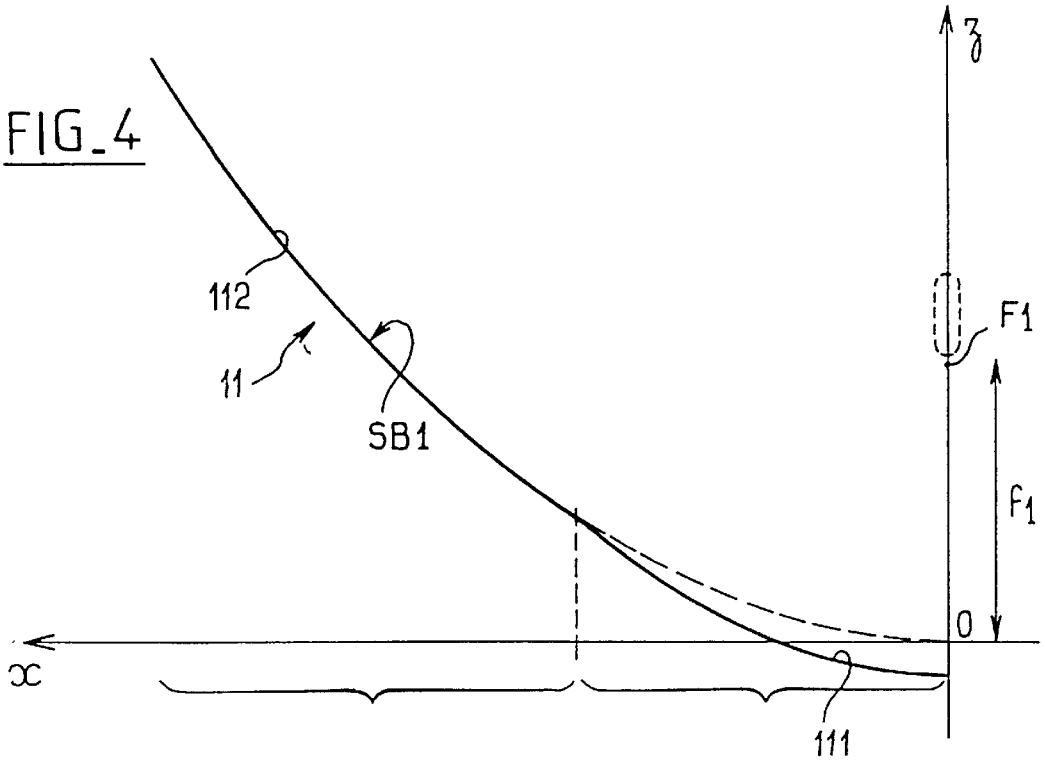
FIG. 4 shows the horizontal generatrix of the said first zone of the reflector.
Figure 5:
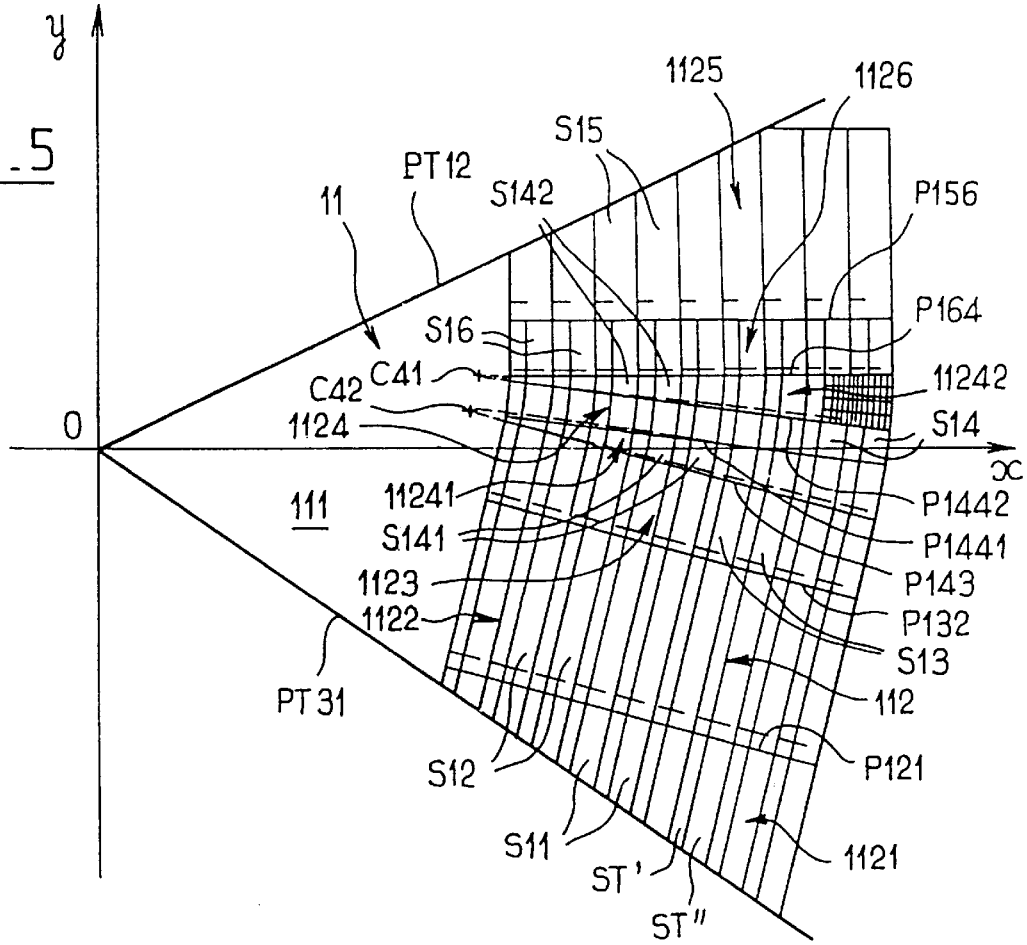
FIG. 5 is a detailed view, in front elevation, of the said first zone of the reflector.

Zone 11 (FIGS. 4 and 5)

The essential purpose of the zone 11 is to ensure that the beam is brought into a region situated below and close to the inclined right hand half cut-off line, with a view to giving satisfactory illumination of the nearside (right hand) verge of the road at distances of the order of 40 meters and more. This zone 11 is defined by a base surface SB1, on which striations are applied for spreading the light. The method of applying these striations will be preferably that which is described in European patent specification No. EP 0 645 578A in the name of the company Valeo Vision.

The base surface is preferably a portion of a paraboloid with a modified base, such as is described in detail in French patent specification No. FR 2 609 148A in the name of the company Valeo Vision, to which reference should be made for more detail.

However, it will be recalled here that these surfaces include vertical sections which are parabolas. The focal length f1 of these parabolas is preferably of the order of 27 mm, while their focus F1 is situated on the axis Oz and offset towards the rear with respect to the center, along the axis Oz of the arc produced by the lamp. This axial offset is preferably in the range between about 2 and 6 mm.

FIG. 4 shows the horizontal generatrix of such a base surface, this base surface being a parabola of the same focal length (27 mm) and having the same focus (offset as indicated above), but having a central portion, or base portion, which is modified in order to ensure convergence of the reflected rays. The dimensioning of this base portion is determined in such a way that the half angle of this convergence, and therefore that of the divergence which follows in the distance, is preferably of the order of 20 degrees. In addition, as is shown in FIG. 4, the transition between the modified portion and the non-modified portion preferably lies at a lateral distance of the order of 50 mm with respect to the optical axis.

The modified central sub-zone 111 of the zone 11 is used just as it is, that is to say it is a smooth, continuous reflecting surface, without either cut-outs or sharp changes of contour.

The outer sub-zone 112, which is purely parabolic, of the zone 11 extends between the central sub-zone 111 and the side edge of the reflector, and receives a certain number of striations, which are not shown on the generatrix of FIG. 4 but which are arranged to ensure well-defined spreading of the light, as will be described below.

This outer sub-zone 112 preferably has a eight regions of striations which are defined as follows.

A first region 1125 lies above a horizontal separation plane P156 which is offset upwardly with respect to the axial plane xOz, and extends as far as the transition half plane PT12 between the zones 11 and 12. The region 1125 comprises vertical striations S15, the profile of which is preferably symmetrical with respect to a vertical central plane, so that these striations may for example be cylindrical. The radius of these striations is determined in such a way that they produce a spreading of the light which is homogeneous with the spreading obtained by the adjacent portion, lying above the half plane PT12, of the zone 12 which will be described later on in this description.

A region 1126 of striations is situated between the horizontal plane P156 and a further horizontal plane P164 which lies below the plane 156 but above the axial plane xOy. The region 1126 consists of further vertical striations S16, which are more compacted, i.e. they are narrower and more numerous, but which provide a spreading effect similar to that obtained from the striations S15.

A region 11242 of striations lies between the plane P164 and a plane P1442 which is inclined at 7.5 degrees downwardly with respect to the plane P164 about a point C41 lying in the plane P164 slightly into the sub-zone 112 of the zone 11. This region 11242 consists of striations S142 which are curved with respect to a center of curvature at the point C41.

A region 1124 of striations lies between the plane P1442 and a plane P1441 which is parallel to, and lies below, the plane P1442. The region 1124 consists of straight striations S14, the directions of which are inclined at 7.5 degrees with respect to the vertical plane yOz.

A region 11241 of striations lies between the plane P1441 and a plane P1443 which is inclined at 7.5 degrees downwardly with respect to the plane P1441 about a point C42. The point C42 is situated in the plane 1441, slightly into the sub-zone 112. The region 11241 consists of striations S141 which are curved with respect to a center of curvature at the point C42.

A region 1123 of striations lies between the inclined plane P143 and a plane P132 which is parallel to the plane P143 and offset downwardly from it. The region 1123 consists of straight striations S13 the directions of which are inclined at 15 degrees with respect to the vertical.

A region 1122 of striations lies between the plane P132 and a plane P121 which is parallel to the plane P132 and offset downwardly from it. The region 1122 consists of striations S12 which are aligned with the striations S13.

Finally, a region 1121 of striations lies between the plane P121 and the transition half plane PT31 at which the zone 11 joins the zone 13. The region 1121 consists of striations S11 which are aligned with the striations S12 and S13.

The profiles of the striations S14 inclined at 7.5 degrees, and those of the striations S13, S12 and S11 which are inclined at 15 degrees, are determined in such a way as to provide spreading, below and along the inclined half cut-off line of the normalised cut off, and to favour illumination in the vicinity of the normalised measuring points 75R and 5OR of the projection screen.

Figure 3:
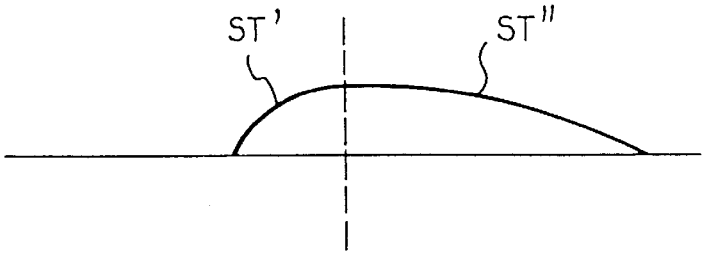
FIG. 3 shows diagrammatically the profile of a striation used in a first zone of the reflector of FIG. 1.

In this regard, the striations S11 to S14 preferably have an asymmetrical profile, such as is shown diagrammatically in projection in FIG. 3, with a portion ST' and a portion ST". The portion ST' has a reduced radius of curvature, such as to provide a high degree of spreading of the light outwardly, that is to say towards the right of the projection screen. The portion ST" has a greater radius of curvature and is adapted for only slight inward spreading of the light, this being in order to preserve a major quantity of light in the central region of the beam, above and in the vicinity of the central bend of the cut-off line.

In addition, the circular guide striations S142 and S141 have downwardly evolving profiles, such as to join, with continuity and without any cut-outs or breaks, on the one hand the striations S16 and S14 (for the striations S142), and on the other hand, the striations S14 and S13 (for the striations S141).

Figure 6A:
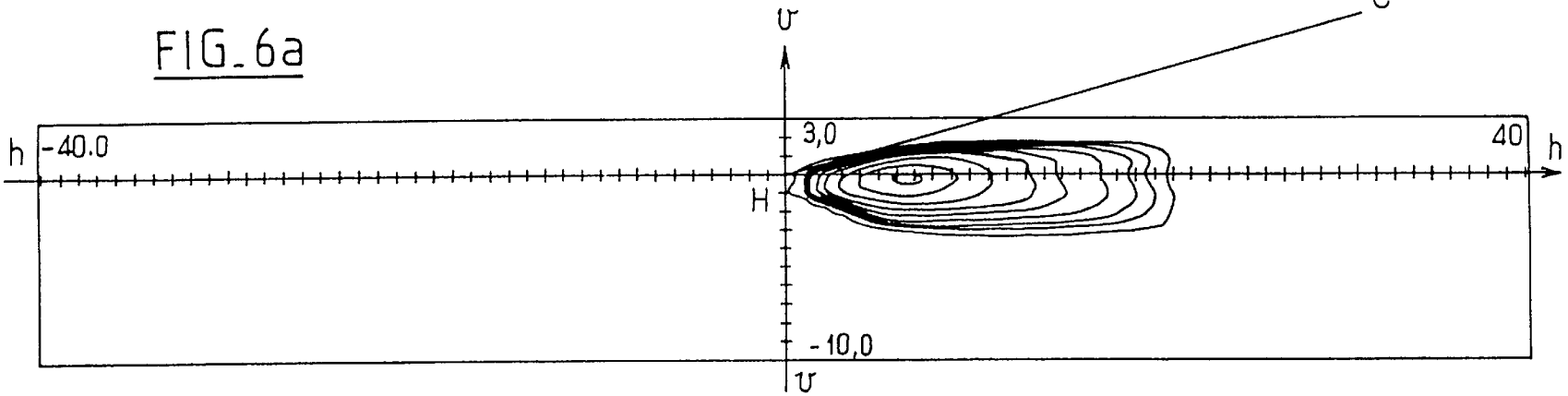
FIGS. 6*a* and 6*b* show the photometric distribution of the beam which is obtained, respectively, with a first sub-zone of the first zone of the reflector and with the whole of the first zone, in the absence of the cover lens.

Reference is now made to FIG. 6*a*, which shows a set of isolux curves on a screen which is graduated in percentages. These curves represent the photometry of that part of the beam which is generated by the smooth sub-zone 111. This part of the beam rises slightly above the horizontal axis, so as to fill the zone situated below the normalised inclined half cut-off line HC.

Figure 6B:
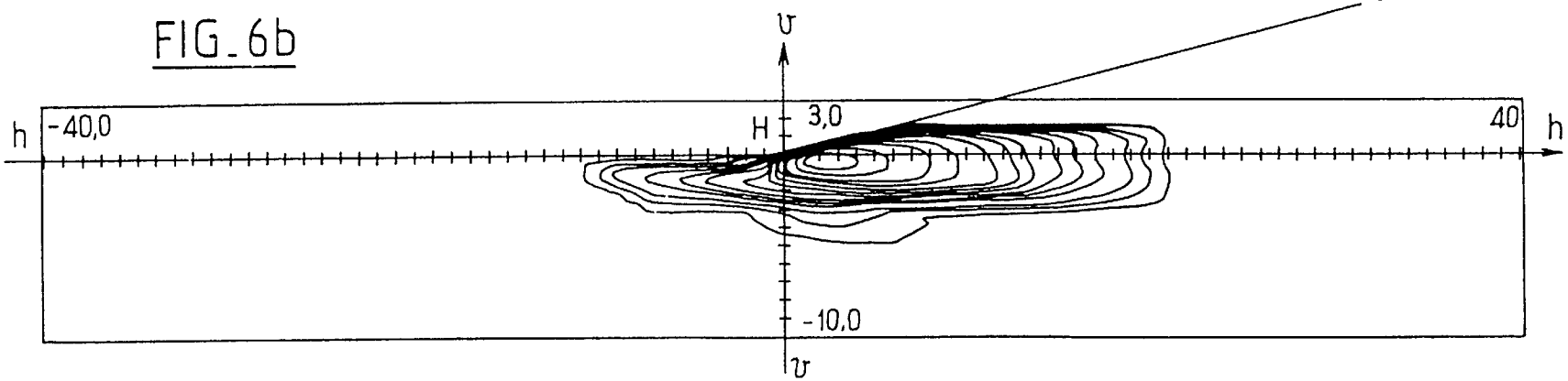

By contrast, FIG. 6*b*, to which reference is also made, shows the light distribution obtained with the whole of the zone 11. It will be observed that the maximum light concentration defining the scope of this part of the beam lies in alignment with the bend in the cut-off line and immediately above the inclined half cut-off line, which is entirely appropriate for good illumination of the nearside edge of the road, and contributes to visual comfort.

Figure 7:
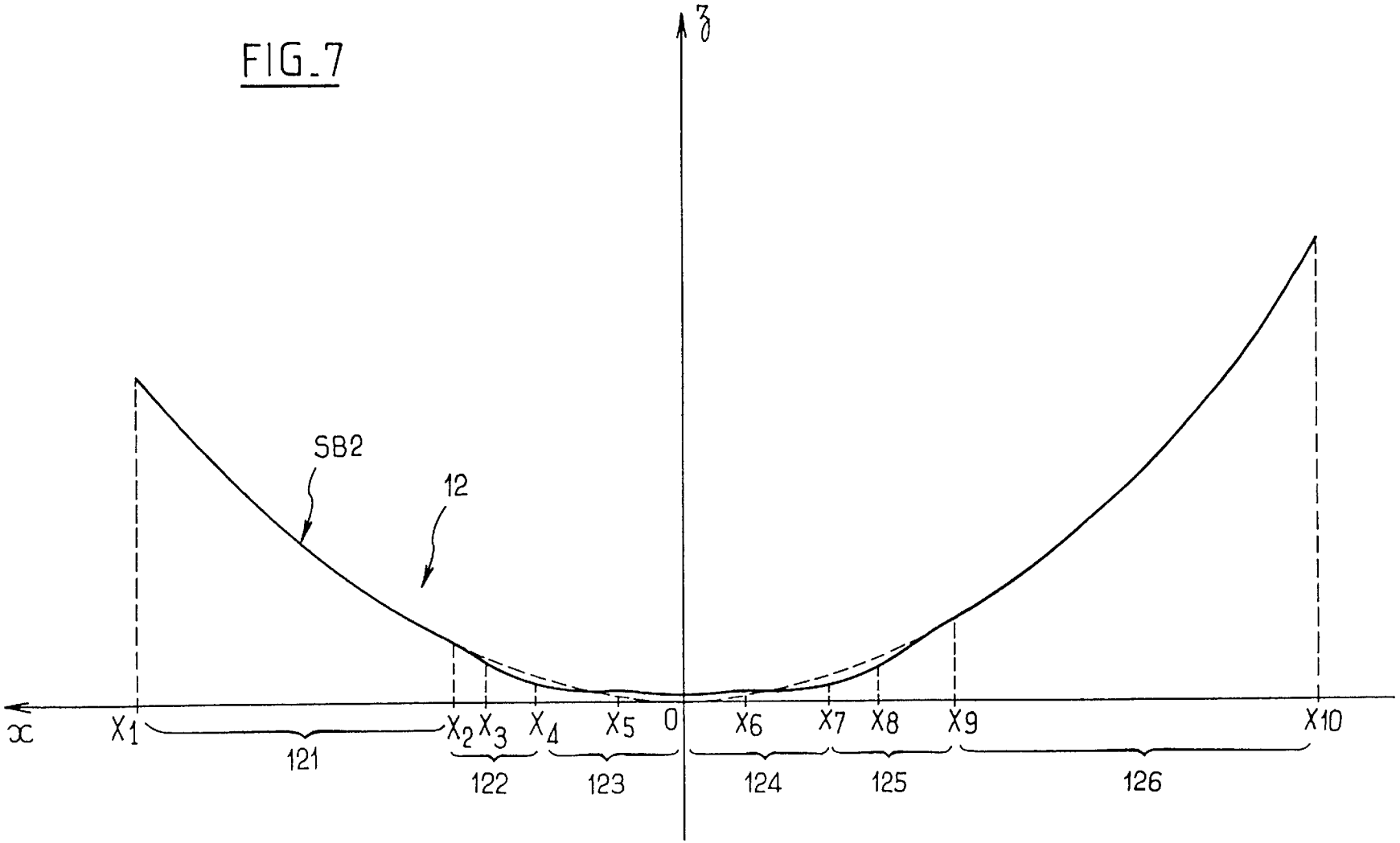
FIG. 7 shows the horizontal generatrix of a second zone of the reflector of FIG. 1.
Figure 8:
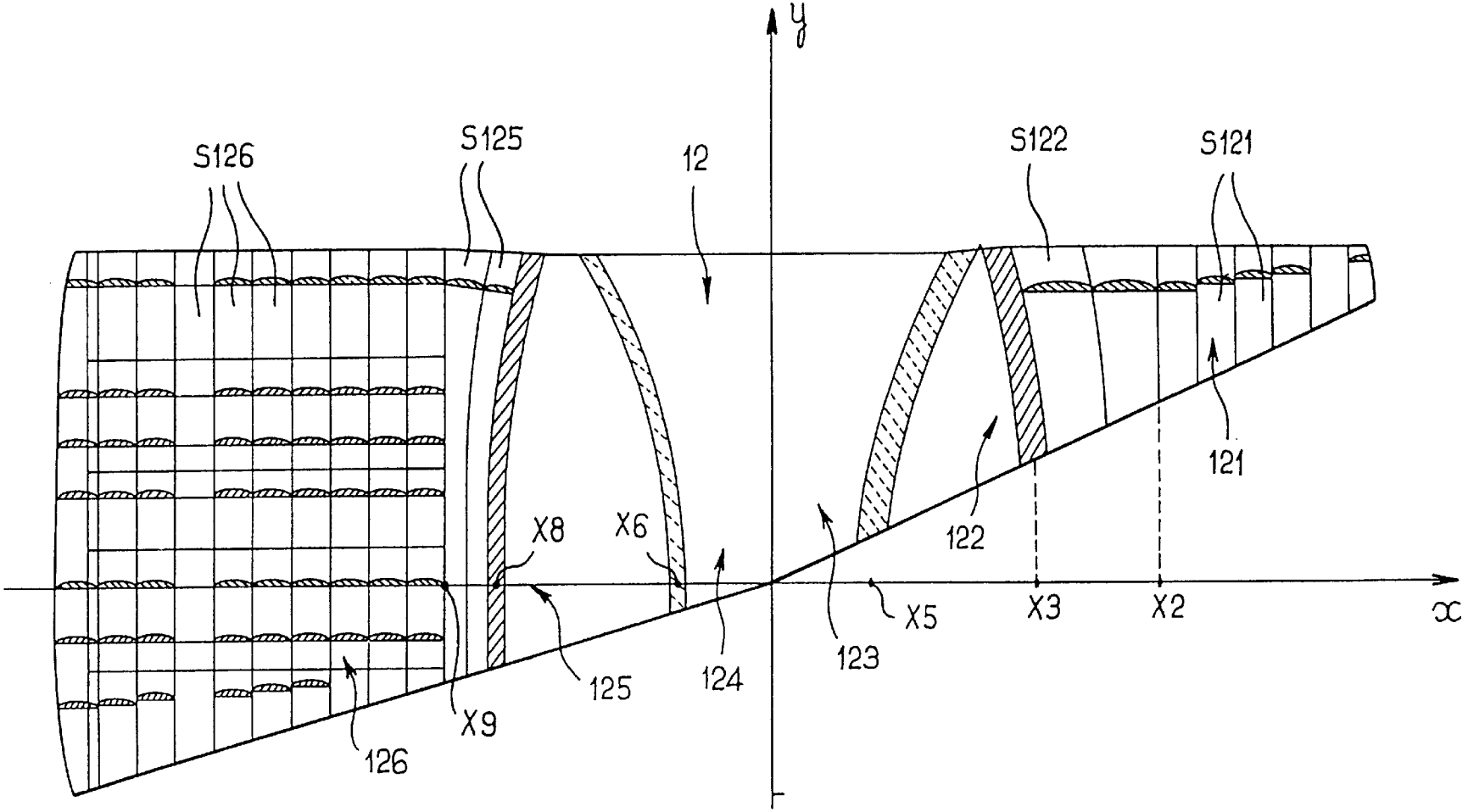
FIG. 8 is a detailed view, in front elevation, of the said second zone of the reflector.

Zone 12 (FIGS. 7 to 9)

This zone is designed to give increased horizontal spreading of the light, so as to give the beam the substantial width that is a factor in visual comfort.

The zone 12 preferably includes a base surface SB2 (on which striations are applied as will be seen later herein), which is constituted, either by a portion of a surface which automatically generates horizontal cut off, as is defined in particular in French patent specification No. FR 2 536 503A, or by a portion of a surface for automatically generating horizontal cut-off with a modified base in the manner defined in French patent specification No. FR 2 609 148A, or again by a portion of a surface for automatically generating horizontal cut-off with modified intermediate zones, in the manner defined in either one of French patent specifications Nos. FR 2 639 888A and FR 2 664 677A. Reference should be made to the descriptions in these various cited specifications for more detail as to the construction of such surfaces.

In the first case, the vertical cross sections of the surface are portions of parabolas with evolving foci, such as to put all the images of the light source below and level with a horizontal cut-off line defined by the horizontal axis hh of the projecting screen.

In the second and third cases, the vertical cross sections of the surface are parabolas. Their focal length is preferably about 24 mm, while their focus is preferably offset towards the rear with respect to the arc generated by the discharge lamp. As regards the horizontal generatrix of such a surface, in the first case this consists of a parabola, while in the second case it is again a parabola, but the base zone of this parabola is modified so as to give convergence of the reflected light, and therefore spreading of the light in the far field. In the third case, the cross section is a parabola which is modified in its central zone by a group of zones which are successively divergent and/or convergent and/or parabolic.

In the present example the base surface is configured in accordance with the dimensioning illustrated in the FIG. 7*b* of French patent specification No. FR 2 664 677A. In other words, the base surface SB2 of the zone 12 includes, in its left hand part, and reading from left to right in FIG. 7 (that is to say in its right hand part and from right to left in FIG. 8), sub-zones 121, 122 and 123. The sub-zone 121 is situated between the planes X1 and X2, and it has a horizontal generatrix. In the sub-zone 122, the horizontal generatrix is modified so as to start (going from the outside towards the inside) from a nil horizontal deviation at the point X2, passing through a maximum horizontal convergence point at point X3 and reverting to nil horizontal deviation at point X4. In the sub-zone 123, the horizontal generatrix is modified so that, starting with nil horizontal deviation at the point X4 and going from the outside towards the inside, it passes through a point of maximum horizontal divergence at point X5, and reverts to nil horizontal deviation at a point lying in the plane of the vertical axis xOz.

These various profiles of the horizontal generatrix of the base surface together constitute a continuous and derivable line (that is to say without any sudden interruption in its slope).

The right hand part of the generatrix of the said base surface may or may not be symmetrical with the left hand part, but it follows the same evolutions in terms of horizontal deviation. This right hand part consists of sub-zones 124, 125 and 126 corresponding to the subzones 123, 122 and 121 respectively, with characteristic points X6 to X10 corresponding to the points X5, X4, X3, X2 and X1 respectively.

In addition, the quantification of the equation of this base surface is preferably such that the maximum horizontal convergence given by the sub-zones 122 and 125 is about 25 to 30 degrees, and the maximum horizontal divergence given by the sub-zones 123 and 124 is about 20 degrees.

The zone 12 has the specific striation pattern which will be described below. First of all, the sub-zones 122 to 125, with modified horizontal generatrix, are left as they are: they are smooth (continous and derivable) over their whole extent. By contrast, each of the two endmost sub-zones 121 and 126, with parabolic base surfaces, includes a set of vertical guide striations which are designed to give a substantial degree of horizontal spreading of the light. These striations are indicated in FIG. 8 at S121 and S126 respectively, and preferably have a profile, before being projected on the surface, in which the radius of the profile is in the range between 20 and 40 mm, the width of the profile preferably being in the range between 6 and 8 mm.

In addition, and in the manner described in the above mentioned European patent specification No. EP 0 645 578A, the striations S121 and S126 may have evolving profiles such that striations aligned vertically with each other can join each other without any discontinuity, which enables optical anomalies such as dazzling parasitic radiation to be avoided.

In a modified version, not only the sub-zones 121 and 126 are given striations, but so also are parts of the sub-zones 122 and 125 which are adjacent to the sub-zones 121 and 126, and which extend between the horizontal planes in the positions X2 and X9, separating the sub-zones 121 and 122 and the sub-zones 126 and 125 respectively, and the lines of maximum convergence passing through the positions X3 and X8 at the level of the axis Ox, in the sub-zones 122 and 125. In other words, striation is also applied on the portions of the sub-zones 122 and 125 in which the horizontal deviation passes from a zero value to a maximum convergence value. These striations may be of complex forms, and in FIG. 8 they are designated by the reference numerals S122 and S125. In this way the horizontal spreading of the light is enhanced.

Figure 9A:
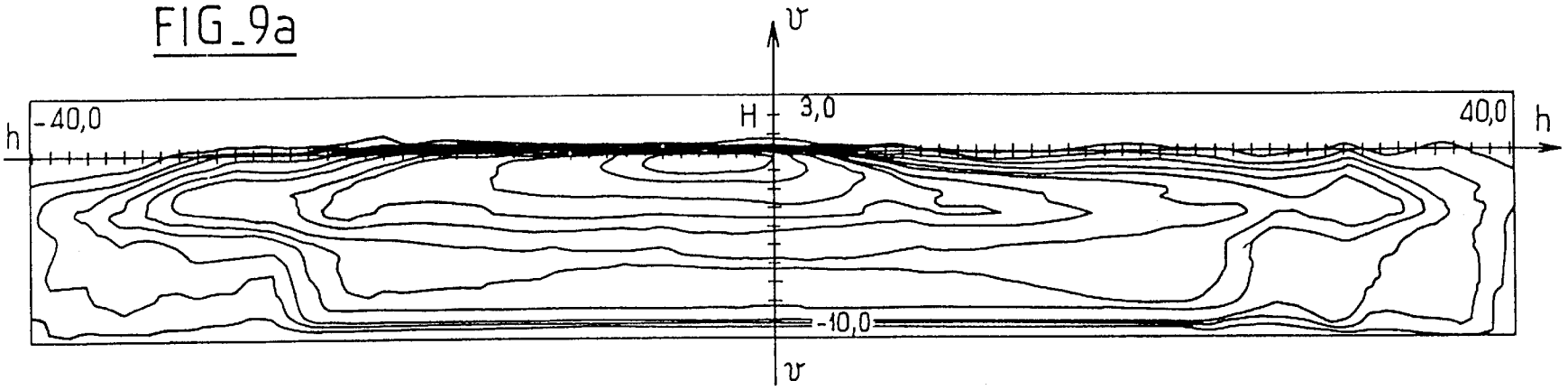
FIGS. 9*a* and 9*b* show the photometric distribution of the beam obtained, respectively, with the second zone of the reflector and with the whole of the first and second zones, in the absence of the cover lens.

FIG. 9*a* shows a set of isolux curves representing the appearance of that part of the beam which is generated by the zone 12 of the reflector in the absence of a cover lens. The high degree of spreading of the light below the horizontal cut-off line hh will be noticed.

Figure 9B:
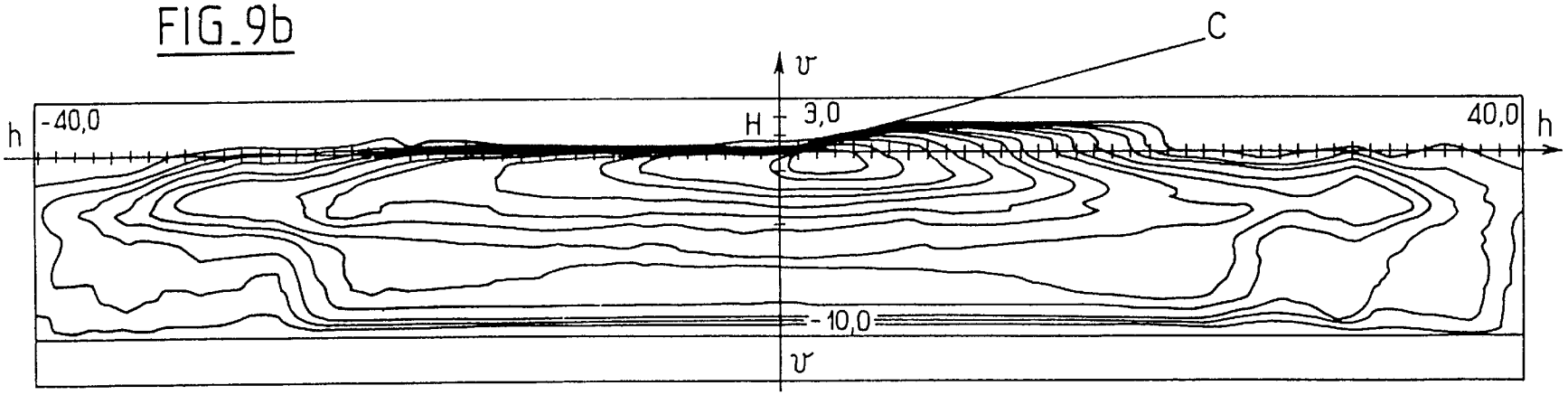

FIG. 9*b* shows the appearance of that part of the beam which is generated by the zones 11 and 12 of the reflector together. It can be seen that there is strong lateral spreading and adequate filling below the inclined half cut-off line Hc close to the axis.

Figure 10:
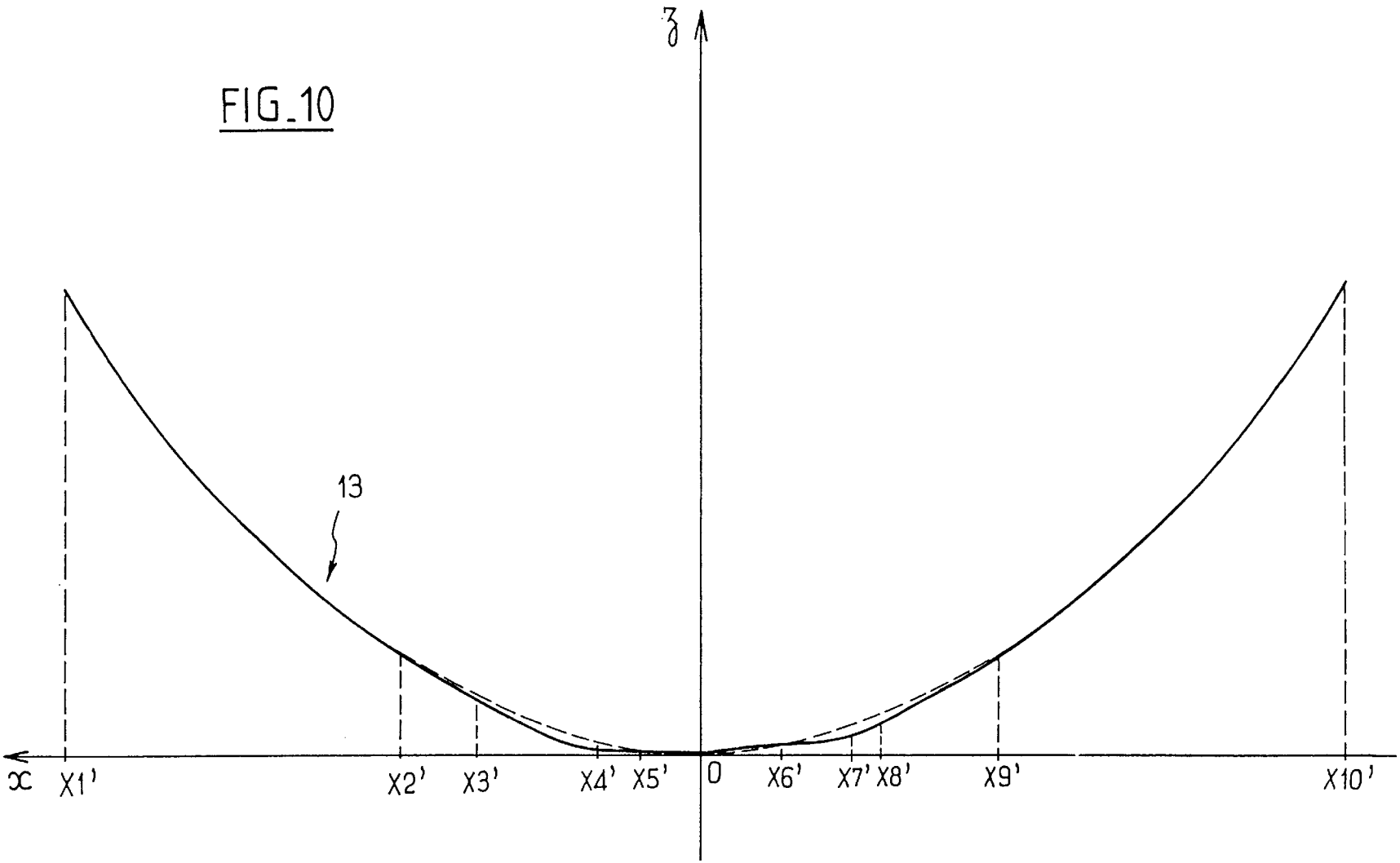
FIG. 10 shows the horizontal generatrix of a third zone of the reflector of FIG. 1.
Figure 11:
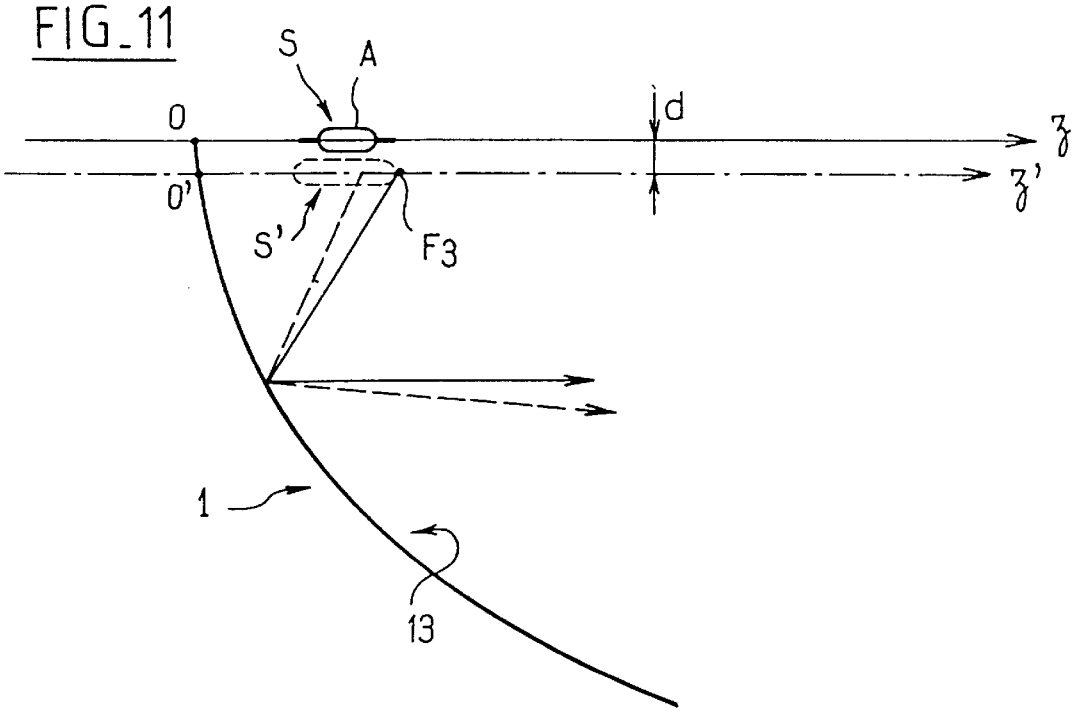
FIG. 11 is a view in vertical axial cross section of the said third zone and of the arc generated by the discharge lamp.
Figure 12:
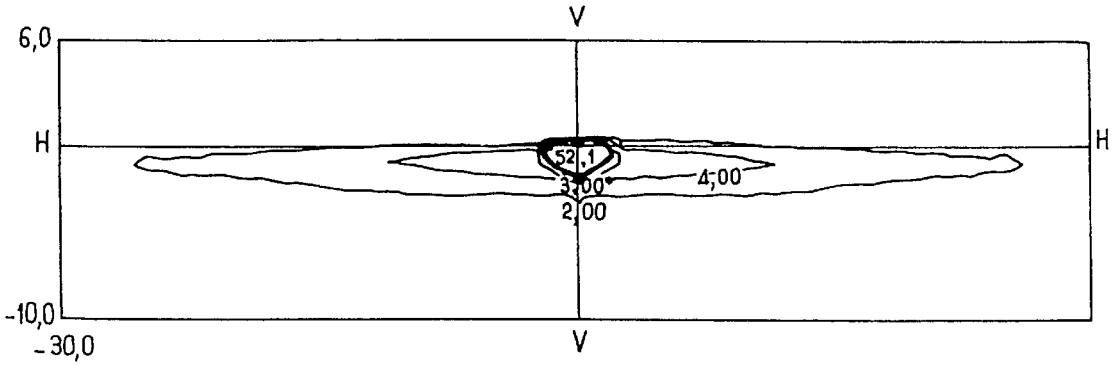
FIG. 12 shows the photometric distribution of the beam which is obtained with the third zone of the reflector, in the absence of the cover lens.

Zone 13 (FIGS. 10 to 12)

This zone, which lies in the lower part of the reflector, between the transition planes PT23 and PT31, is preferably a surface which is constructed in a similar way to the base surface of the zone 12, that is to say in the way described in French patent specification No. FR 2 664 677A, and more particularly in FIG. 11*b* of the latter.

However, by contrast with zone 12, zone 13 does not have any striations, and the result of this is to leave, in a portion of the beam which is generated, an area of high concentration of light in the axis directed along the road.

In the present example, the equation of the zone 13 is obtained with parameters X1' to X10', the definition of which corresponds to that of the parameters X1 to X10 of the base surface of the zone 12. These parameters may have values which are identical to, or different from, those of the corresponding variables in zone 12.

Preferably, the base focal distance of the surface of the zone 13 (i.e. the parameter $f_o$ in French patent specification No. FR 2 664 677A) is smaller than that employed for zone 12, and is preferably in the region of 21 mm. In addition, it is of advantage if the axis of this surface (i.e. the axis Oz' in FIG. 11, corresponding to the axis Ox in French patent specification No. FR 2 664 677A) is offset downwardly by a distance d with respect to the axis Oz which is common to the discharge lamp and to the surfaces of the zones 11 and 12.

In this connection it will be observed that, in an arc lamp, the arc A which is produced between the electrodes constitutes the main light source denoted S, but the salts present in the lower part of the lamp, under the arc, also give rise to a certain quantity of light which constitutes a parasitic secondary light source denoted S'.

By offsetting the axis of the surface of the zone 13 downwardly so that it extends into the vicinity of the secondary light source S', the generation of images of the latter which largely overlap above the cutoff line, and which are liable to dazzle drivers of vehicles travelling in the opposite direction, is avoided. Preferably, with discharge lamps currently available commercially, an offset d close to 1.5 mm is chosen.

The base focus F3 of the surface of the zone 13 preferably lies on the axis Oz', immediately in front of the secondary source S'.

In addition, the parameters of the surface of the zone 13 are preferably so selected that, going from the center towards the side edges of this zone, the horizontal deviation which is imparted passes progressively from a zero value to a maximum divergence of the order of 35 degrees, and then to a maximum convergence of the order of 55 degrees, followed by a new zero deviation in the region of the lateral portions with a parabolic profile.

With this configuration, the portion of the beam which is generated by the zone 13 is as shown in FIG. 12, with, at the same time, high concentration on the axis and a high degree of spread which contributes to visual comfort.

If necessary, it is of course possible to increase even more the width of this part of the beam, or to reinforce the intensity of its widened regions, by providing striations on the surface in, for example, the regions of maximum convergence and divergence.

Thanks to the use of the reflective zones 11, 12 and 13 which have a specific role as described above, a beam can be obtained which has, at the same time, a large width, giving substantial horizontal spread, and an area of high concentration of light in the axis directed along the road, giving satisfactory long-range illumination, all without the aid of the cover lens.

In addition, the design of the reflector is facilitated because each reflective zone no longer corresponds to a geometrical portion of the beam as in the prior art, but rather to a functional part of the beam represented by the horizontal spread and the range.

The present invention is of course in no way limited to the embodiment described above and shown in the drawings: a person skilled in this technological field will be able to apply to it any variation or modification within the spirit of the invention.

What is claimed is:

1. A motor vehicle headlamp comprising a discharge lamp, a reflector adjacent to the discharge lamp, and a cover lens in front of the reflector, the cover lens being at least approximately smooth, the headlamp defining a cut-off line and the reflector being adapted to reflect light from the discharge lamp whereby to generate a beam below the said cut-off line, the headlamp further including at least two masks associated with the discharge lamp and defining two shadow zones on the reflector, the reflector including at least two reflective zones for forming portions of the beam below the said predetermined cut-off line with different degrees of widthwise spreading, the reflector defining generally radial transition planes separating the said reflective zones, with at least some of the said transition planes extending into the said shadow zones.

2. A headlamp according to claim 1, wherein the said reflective zones include a first zone extending essentially laterally with respect to the discharge lamp.

3. A headlamp according to claim 2, defining a first half plane inclined above the horizontal and a second half plane inclined below the horizontal, the said first zone of the reflector extending between the said first and second half planes, with the second half plane extending into one of the said shadow zones.

4. A headlamp according to claim 2, wherein the said first zone of the reflector includes a first sub-zone close to the discharge lamp and having a horizontal generatrix derived from a parabola so as to cause light reflected by the said first sub-zone to be convergent, and a second sub-zone spaced away from the discharge lamp and having an essentially parabolic horizontal generatrix.

5. A headlamp according to claim 4, wherein the generatrices of the said first and second sub-zones are joined together with continuity and without interruption of slope.

6. A headlamp according to claim 4, wherein the reflector further includes a plurality of striations on the second sub-zone for spreading light, the second sub-zone having a base surface generated with the aid of the said generatrix, and the said striations being applied on the said base surface.

7. A headlamp according to claim 6 in which the said cut-off line has an inclined portion, and wherein the spreading striations are distributed in at least two groups, comprising at least one first group and at least one second group, the said first group being adapted to spread the light horizontally and the said second group being adapted to spread the light in an oblique direction essentially parallel to the said inclined portion of the cut-off line.

8. A headlamp according to claim 7, wherein the said groups of spreading striations include a third, curve guide, group giving continuous transition from one striation to another as between striations of the first group and striations of the second group.

9. A headlamp according to claim 3, wherein the said first and second half planes are radial planes, the first half plane being inclined by about 25 degrees above the horizontal and the second half plane being inclined by about 30 degrees below the horizontal.

10. A headlamp according to claim 1, wherein the reflector includes a lateral portion opposed to the first zone, the reflective zones further including a second zone extending below the said first zone and into the said lateral portion of the reflector.

11. A headlamp according to claim 3, wherein the reflector includes a lateral portion opposed to the first zone, and a second zone extending below the said first zone and into the said lateral portion of the reflector, the reflector further defining a third half plane situated substantially in alignment with the said first half plane and extending into the other shadow zone, the said second zone being delimited by the said first and third half planes.

12. A headlamp according to claim 11, wherein the third half plane is a radial half plane inclined at about 20 degrees below the horizontal.

13. A headlamp according to claim 10, wherein the reflector includes a base surface in its said second zone, the said base surface having a horizontal generatrix with a profile adapted to give horizontal deviation of light, the said profile, considered from the center towards the side edges of the zone, varying between two nil values and passing locally through maximum values of convergence and divergence.

14. A headlamp according to claim 13, wherein the said horizontal generatrix of the second zone is continuous and without interruption of slope.

15. A headlamp according to claim 13, wherein the said second zone includes lateral sub-zones, the said horizontal generatrix being parabolic in two said lateral sub-zones.

16. A headlamp according to claim 15, wherein the reflector further includes striations for horizontal spreading of the light, the lateral sub-zones defining base portions thereof, and the said striations being formed on the base surfaces of the said two lateral sub-zones.

17. A headlamp according to claim 1, wherein the reflective zones of the reflector further include a third zone extending in a lower part of the reflector between the said first and second zones.

18. A headlamp according to claim 17, wherein the said third zone has a surface having a horizontal generatrix with a profile adapted to give horizontal deviation of light, the said profile, considered from the center towards the side edges of the zone, varying between two nil values and passing locally through maximum values of convergence and divergence.

19. A headlamp according to claim 18, wherein the said horizontal generatrix of the second zone is continuous and without interruption of slope.

20. A headlamp according to claim 18, wherein the said third zone includes lateral sub-zones, the said horizontal generatrix of the third zone being parabolic in two said lateral sub-zones.

21. A headlamp according to claim 17, wherein the surface of the said third zone is entirely smooth and without any interruption of slope.

22. A headlamp according to claim 13, wherein the reflective zones of the reflector further include a third zone extending in a lower part of the reflector between the said first and second zones, the said third zone having a surface which has a horizontal generatrix defining a profile adapted to give horizontal deviation of light, the said profile, considered from the center towards the side edges of the zone, varying between two nil values and passing locally through maximum values of convergence and divergence, coincidence of the generatrix of the base surface of the second zone with the generatrix of the said surface of the third zone being absent.

23. A headlamp according to claim 22, wherein the generatrices of the base surface of the second zone and of the said surface of the third zone have different base focal lengths.

24. A headlamp according to claim 23, wherein the focal length of the generatrix of the surface of the third zone is shorter than that of the generatrix of the said surface of the second zone.

25. A headlamp according to claim 17, wherein the said first and second zones define a common geometric axis, the said third zone having a geometric axis offset downwardly with respect to the said common axis and extending parallel to the said common axis.

26. A headlamp according to claim 25, wherein the geometric axis of the third zone is offset downwardly from the said common axis by about 1 to 2 millimeters.

27. A headlamp according to claim 1, wherein one of the said reflective zones of the reflector has a smooth base surface and striations applied by geometric projection on the said smooth base surface, each said striation defining a summit and a profile comprising portions of different curvatures on either side of the said summit.

* * * * *